US008388106B2

(12) United States Patent
Kurosu et al.

(10) Patent No.: US 8,388,106 B2
(45) Date of Patent: Mar. 5, 2013

(54) INK DISCHARGE HEAD AND MANUFACTURING METHOD THEREOF

(75) Inventors: Toshiaki Kurosu, Kawasaki (JP); Satoshi Ibe, Yokohama (JP); Kazuhiro Asai, Kawasaki (JP); Yoshinori Tagawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 199 days.

(21) Appl. No.: 12/956,678

(22) Filed: Nov. 30, 2010

(65) Prior Publication Data

US 2011/0141193 A1 Jun. 16, 2011

(30) Foreign Application Priority Data

Dec. 10, 2009 (JP) ..... 2009-280372

(51) Int. Cl.
*B41J 2/135* (2006.01)

(52) U.S. Cl. ..... 347/44; 347/20; 347/50; 347/63; 216/27; 427/510

(58) Field of Classification Search ..... None
See application file for complete search history.

(56) References Cited

U.S. PATENT DOCUMENTS

| | | | | |
|---|---|---|---|---|
| 5,436,650 | A * | 7/1995 | Kobayashi et al. | 347/63 |
| 5,478,606 | A | 12/1995 | Ohkuma et al. | |
| 5,682,187 | A * | 10/1997 | Watanabe et al. | 347/45 |
| 6,139,761 | A * | 10/2000 | Ohkuma | 216/27 |
| 6,799,831 | B2 * | 10/2004 | Inamoto et al. | 347/44 |
| 7,282,243 | B2 * | 10/2007 | Ohkuma et al. | 427/510 |
| 8,104,872 | B2 * | 1/2012 | Kwon et al. | 347/47 |
| 2007/0017894 | A1 * | 1/2007 | Murayama et al. | 216/27 |
| 2008/0094454 | A1 | 4/2008 | Koyama et al. | |
| 2009/0191487 | A1 | 7/2009 | Murayama et al. | |
| 2009/0225136 | A1 | 9/2009 | Fujii et al. | |
| 2009/0315956 | A1 | 12/2009 | Ishida et al. | |
| 2009/0315958 | A1 | 12/2009 | Hatsui et al. | |
| 2011/0050828 | A1 | 3/2011 | Fujii et al. | |

FOREIGN PATENT DOCUMENTS

| | | |
|---|---|---|
| EP | 0 609 860 A2 | 8/1994 |
| JP | 6-286149 A | 10/1994 |

* cited by examiner

*Primary Examiner* — Matthew Luu
*Assistant Examiner* — John P Zimmermann
(74) *Attorney, Agent, or Firm* — Fitzpatrick, Cella, Harper & Scinto

(57) ABSTRACT

An ink discharge head includes a coating resin layer having a plurality of discharge ports for discharging ink, and ink flow passages which communicate with the plurality of discharge ports, respectively; and a substrate having energy generation elements which generate the energy for discharging ink and provided with the coating resin layer. A crack inducing portion for relieving the stress produced at the interface between the coating resin layer and the substrate is formed at lateral faces of the outer peripheral edge of the coating resin layer.

9 Claims, 4 Drawing Sheets

INK DISCHARGE HEAD AND MANUFACTURING METHOD THEREOF

BACKGROUND OF THE INVENTION

1. Field of the Invention

The present invention relates to an ink discharge head for discharging a recording liquid used for an ink jet recording system, and manufacturing method thereof.

2. Description of the Related Art

Conventionally, an ink jet recording system in which an ink droplet is discharged and the ink droplet is made to adhere to a print medium, such as paper, is known. In this ink jet recording system, the noise during recording operation is small, high-speed recording operation is possible, and it is possible to miniaturize the ink discharge head itself. Thus, this ink jet recording system is a recording system which is easy to miniaturize.

As a method of discharging an ink droplet, there are a method of controlling an applied voltage to a piezoelectric element and discharging an ink droplet using a mechanical change of an element, and a method of bubbling ink by a heat generating element, and discharging an ink droplet, utilizing the air bubble expansion at that time.

With the recent development of ink jet recording technique, higher density and higher definition are required in an ink jet recording technique. In order to satisfy this requirement, for example, a method for manufacturing a nozzle tip is suggested (Japanese Patent Application Laid-Open No. H6-286149) in which a nozzle layer is formed using a resin material capable of being patterned by photolithography, on a silicon wafer in which heat generating elements and a drive circuit are provided in advance.

In this manufacturing method, the resin layer for formation of ink flow passages is formed in advance in a predetermined pattern, using a resin material capable of being removed with a solvent. Then, a nozzle tip is formed by covering the top of the pattern of the resin layer for formation of ink flow passages with a coating resin layer, such as epoxy resin, processing nozzles in a coating resin layer, and removing the resin layer for formation of ink flow passages with a solvent.

Meanwhile, in the ink jet recording technique, higher recording operation speed is also required. A method of realizing higher speed includes, for example, increasing the dimensions of the ink discharge head, thereby increasing the number of discharge ports for ink droplets, in the manufacturing method of Japanese Patent Application Laid-Open No. H6-286149. It is thereby possible to increase the quantity of ink droplets capable of being discharged per unit period, and to achieve higher recording operation speed.

However, since the volume of the coating resin layer which becomes the nozzle layer increases in a case where the ink discharge head is lengthened, the stress generated when the coating resin layer is cured will increase. For this reason, the deformation of the ink discharge head itself will increase with the lengthening of the ink discharge head.

Additionally, in a case where the mounting of fixing the ink discharge head to a head support with an adhesive for mounting is performed in a state where the deformation of the ink discharge head is large, a tensile stress is generated in the ink discharge head due to the stress generated when the adhesive for mounting is cured. Also, since the direction in which the stress caused by the adhesive for mounting is generated is a direction opposite to the stress which acts on the coating resin layer, a larger shear stress is generated at the interface between the coating resin layer and the substrate. For this reason, peeling-off may occur at the interface between the coating resin layer and the substrate.

In a case where peeling-off has occurred at the interface between the coating resin layer and the substrate, ink permeates from this interface. Then, when the ink which has permeated arrives at the drive circuit on the substrate, this becomes the primary factor corroding the drive circuit and degrading the reliability of the quality of a product. Also, in a case where such peeling-off has occurred in a manufacturing process, this becomes a cause of a reduced production yield and increased manufacturing costs.

SUMMARY OF THE INVENTION

Thus, the invention is directed to an ink discharge head and manufacturing method thereof capable of preventing peeling-off from occurring at an interface between a coating resin layer and a substrate, and improving the reliability of excellent recording quality, even in a case where the ink discharge head is lengthened.

In order to achieve the above-described object, an ink discharge head related to the invention includes a coating resin layer having a plurality of discharge ports for discharging ink, and ink flow passages which communicate with the plurality of discharge ports, respectively; and a substrate having energy generation elements which generate the energy for discharging ink and provided with the coating resin layer. A crack inducing portion for relieving the stress produced at the interface between the coating resin layer and the substrate is formed at lateral faces of the outer peripheral edge of the coating resin layer.

According to the invention, it is possible to keep peeling-off from occurring at the interface between the coating resin layer and the substrate due to the stress of an adhesive used when the ink discharge head is mounted, and it is possible to improve the reliability of the recording quality of the ink discharge head.

Further features of the present invention will become apparent from the following description of exemplary embodiments with reference to the attached drawings.

DESCRIPTION OF THE EMBODIMENTS

Preferred embodiments of the invention will now be described in detail with reference to the accompanying drawings.

Figure 1A:
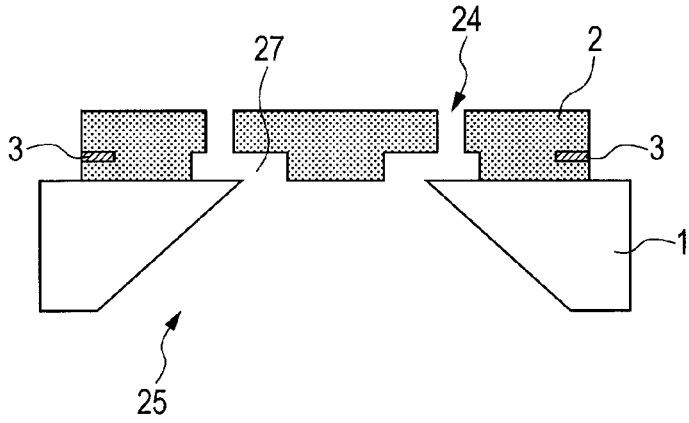
FIGS. 1A, 1B, 1C and 1D are sectional views schematically illustrating an example of an ink jet recording head of an embodiment.
Figure 1B:
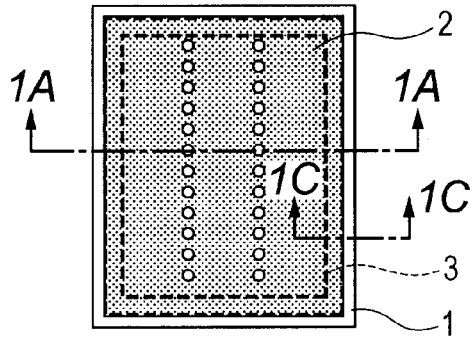

As shown in FIGS. 1A and 1B, a nozzle tip serving as an ink discharge head includes a silicon wafer 1 (hereinafter referred to as a heater board 1) serving as a substrate on which heat generating elements serving as energy generation elements which generate the energy for discharging ink are formed. Additionally, the nozzle tip includes a coating resin layer 2 which constitutes a nozzle layer which discharges ink. FIG. 1A is a sectional view taken along the line 1A-1A of FIG. 1B.

Although not illustrated, the heater board 1 is formed with a drive circuit which drives the heat generating elements. Additionally, as shown in FIG. 1A, the heater board 1 is formed with an ink supply port 25 for supplying ink into bubbling chambers where the heat generating elements are arranged. The coating resin layer 2 is formed on the heater board 1, and has a plurality of discharge ports 24 for discharging ink, and ink flow passages 27 which communicate with the plurality of discharge ports 24, respectively. The nozzle tip is formed in a quadrangular shape in a plane parallel to the interface between the coating resin layer 2 and the heater board 1.

A crack inducing pattern 3 serving as a crack inducing portion for relieving the stress produced at the interface between the coating resin layer 2 and the heater board 1 is formed from the inside of the coating resin layer 2 to the lateral faces of the outer peripheral edge (outermost peripheral portion) on the coating resin layer 2 of the nozzle tip. The crack inducing pattern 3 is formed parallel to the interface between the coating resin layer 2 and the heater board 1 from a material different from the coating resin layer 2. At this time, desirably, the crack inducing pattern is formed from a material or has a structure such that the adhesion force between the crack inducing pattern 3 and the coating resin layer 2 becomes smaller than the adhesion force between the heater board 1 and the coating resin layer 2.

Figure 1C:
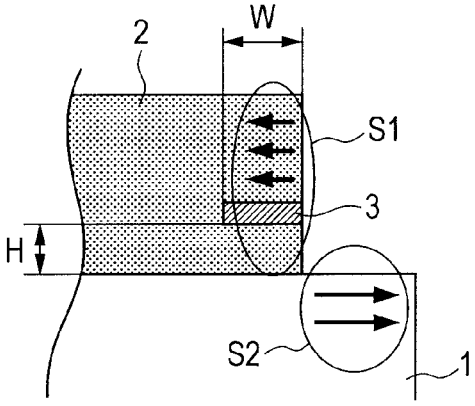

As shown in FIG. 1C, the height H of the crack inducing pattern 3 from the interface between the heater board 1 and the coating resin layer 2 is appropriately changed according to one of the stress S1 produced when the coating resin layer 2 itself is cured and the stress S2 generated due to curing shrinkage of an adhesive for mounting. By changing the height H of the crack inducing pattern 3 appropriately, it is possible to efficiently relieve the stress generated at the interface between the coating resin layer 2 and the heater board 1. FIG. 1C is a sectional view taken along the line 1C-1C of FIG. 1B.

Figure 1D:
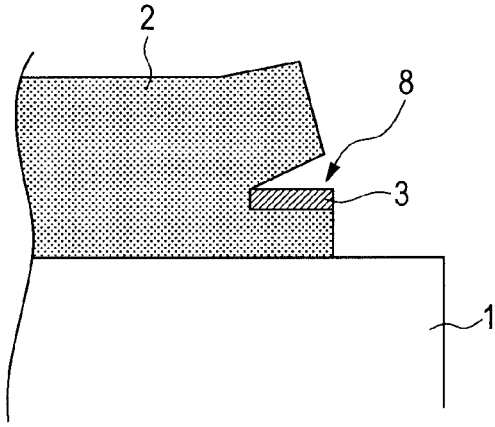

Specifically, in the nozzle tip, the crack inducing pattern 3 is formed at a position lower than the height (thickness) of the coating resin layer 2 in which peeling-off occurs at the interface between the coating resin layer 2 and the heater board 1. Thereby a crack 8, which is generated from a lateral face of the outer peripheral edge of the coating resin layer 2 shown in FIG. 1D, in the vicinity of the crack inducing pattern 3 can be more stably induced.

Additionally, it is desirable to arrange the crack inducing pattern 3 over the entire outer peripheral edge of the nozzle tip. Further, even if the crack inducing pattern 3 is adapted to be provided at least at four corners of the quadrangular nozzle tip, the effect that the stress generated at the interface between the coating resin layer 2 and the heater board 1 is relieved is obtained. Additionally, similarly, even if a crack inducing pattern 3 is adapted to be provided only at lateral faces of the portion to which the adhesive comes into contact at the time of the mounting when the nozzle tip is fixed to a tip support (head support), the effect that the stress generated at the interface between the coating resin layer 2 and the heater board 1 is relieved is obtained.

It is possible to change the width of the crack inducing pattern 3 appropriately according to the stress of a resin material (resist) which constitutes the coating resin layer 2. By increasing the width W of the crack inducing pattern 3, it is possible to control the width by which the crack 8 extends toward the inside of the coating resin layer 2. It is thereby possible to control the width of the crack 8 which is generated in the coating resin layer 2.

The constituent materials of the crack inducing pattern 3 may be materials such that the adhesion force between a resin material which constitutes the coating resin layer 2 and the crack inducing pattern 3 is made lower than the adhesion force at the interface between the coating resin layer 2 and the heater board 1. Although examples of the constituent materials of the crack inducing pattern 3 typically include metal layers, such as Pt, Au, W, and Ta in which the force of adhesion with the resin material of the coating resin layer 2 is relatively low, other materials may be applied as long as materials which satisfy the condition of adhesion force described above are used. Additionally, as the constituent materials of the crack inducing pattern 3, an alloy including any one material among Pt, Au, W, and Ta may be used.

Figure 2A:
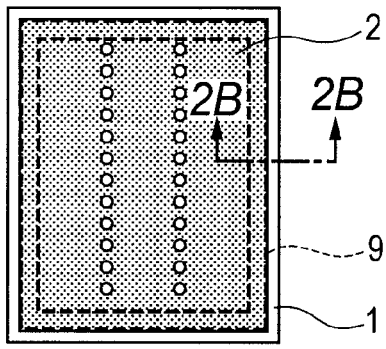
FIGS. 2A, 2B and 2C are sectional views schematically illustrating an example of an ink jet recording head of another embodiment.
Figure 2B:
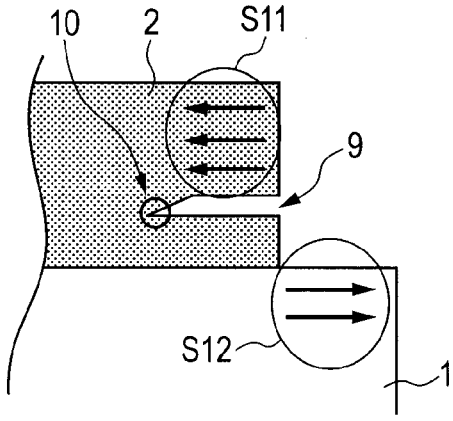

Additionally, the crack inducing pattern may be formed, for example, by forming a resin pattern using a resin material different from the coating resin layer 2, as a sacrificial layer instead of the metal layer, forming discharge ports in the coating resin layer 2, and then removing this resin pattern. As shown in FIG. 2B, it is thereby possible to form a gap (slit) 9 from the inside of the coating resin layer 2 to the lateral faces of the outer peripheral edge of the coating resin layer 2. Even in the slit 9, similarly to the above, by changing the slit appropriately according to one of the stress S11 produced in the coating resin layer 2 and the stress S12 generated due to the adhesive for mounting, it is possible to obtain the effect that the stress generated at the interface between the coating resin layer 2 and the heater board 1 is efficiently relieved.

Figure 2C:
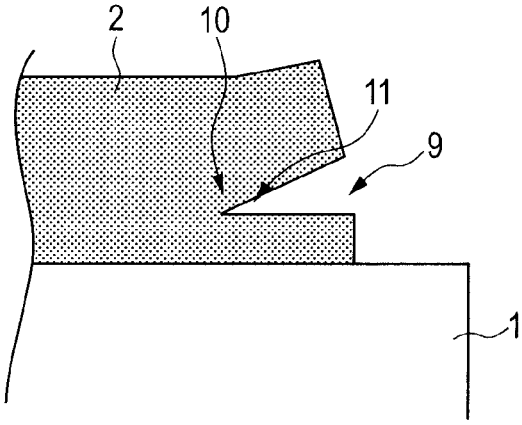

By using the resin pattern as a sacrificial layer, it is possible to simplify a forming step and a processing step of the metal layer, and it is also possible to reduce the manufacturing costs required for a manufacturing process. Additionally, at this time, by appropriately selecting the resin to be used as the sacrificial layer, as shown in FIGS. 2A and 2B, it is possible to select the angle formed by a tip portion 10 of the slit 9 which extends toward the inside of the coating resin layer 2, as an acute angle. As shown in FIG. 2C, it is thereby possible to concentrate a stress on the tip portion of the crack inducing pattern 3, and to cause the crack 11 efficiently in the tip portion 10 of the slit 9 of the coating resin layer 2. FIG. 2B is a sectional view taken along the line 2B-2B of FIG. 2A.

Additionally, by setting a height-defining resin layer for defining the height H of the crack inducing pattern 3 to a resin material different from the coating resin layer 2, the height-defining resin layer may be removed after the coating resin layer 2 is patterned.

Figure 3A:
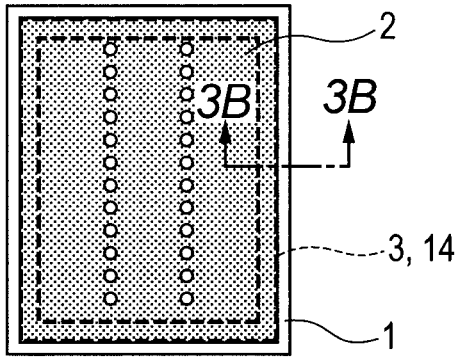
FIGS. 3A, 3B and 3C are sectional views schematically illustrating an example of an ink jet recording head of still another embodiment.
Figure 3B:
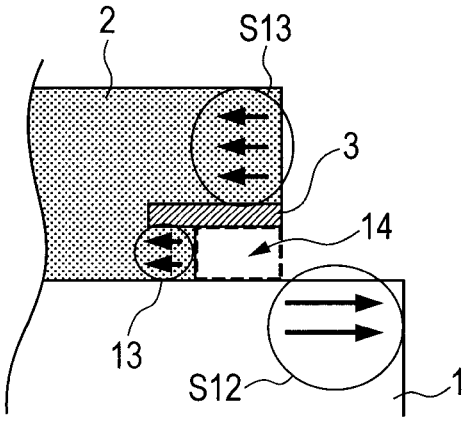
Figure 3C:
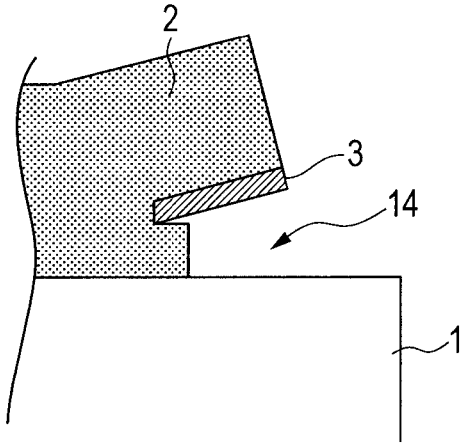

In this case, as shown in FIGS. 3A, 3B, and 3C, it is possible to form the lateral faces of the outer peripheral edge of the coating resin layer 2 with an air gap 14, which is formed adjacent to the interface between the heater board 1 and the coating resin layer 2 and the crack inducing pattern 3 including a metal layer, respectively. Thereby, since the volume of the coating resin layer 2 decreases, the stress S13 produced in the coating resin layer 2 is reduced. Accordingly, it is possible to further suppress occurrence of the peeling-off itself caused at the interface between the coating resin layer 2 and the heater board 1 due to the stresses S12 and S13 which are generated due to the curing shrinkage of the adhesive for mounting. FIG. 3B is a sectional view taken along the line 3B-3B of FIG. 3A.

As described above, according to the nozzle tip of the present embodiment, the crack inducing pattern 3 is provided in advance at the lateral faces of the outer peripheral edge of the coating resin layer 2. Through a crack which has been selectively generated by the crack inducing pattern 3, it is possible to reduce the stress generated in the coating resin layer 2 and the stress of an adhesive used when the nozzle tip is mounted, and to prevent the interface between the coating resin layer 2 and the heater board 1 from being peeled off.

Hereinafter, a method for manufacturing an ink discharge head in a working example will be specifically described with reference to the drawings.

Figure 4A:
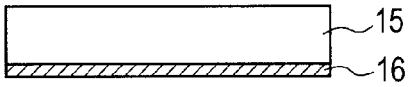
FIGS. 4A, 4B, 4C, 4D, 4E, 4F, 4G, 4H and 4I are sectional views schematically illustrating an example of a method for manufacturing an ink jet recording head of a working example.

First, as shown in FIG. 4A, a silicon wafer in which heat generating elements and a drive circuit which are not illustrated are formed and which is 150 mm in diameter and 625 μm in thickness was prepared as a heater board 15. In the heater board 15, the heat generating elements and the drive circuit are formed on a principal surface in which a nozzle layer which discharges ink is formed. Additionally, as shown in FIG. 4A, a thermal oxidation film 16 is formed on the rear surface of the heater board 15 with a film thickness of 3000 Å.

Figure 4B:
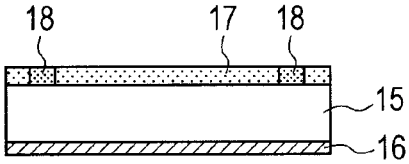
Figure 4C:
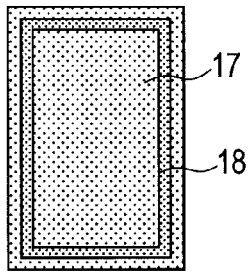

Next, as shown in FIGS. 4B and 4C, a coating resin layer 17 serving as a height-defining resin layer for forming a crack inducing pattern was coated on the heater board 15 by spin coating. As the coating resin layer 17, a negative resist (SU-8 made by Nippon Kayaku Co., Ltd.) was used. Under coating conditions in which the rotational frequency during spinning coating is 600 rpm, the baking temperature after the coating is 90° C., and the baking time is 6 minutes, baking processing was performed. Thereafter, when the thickness of the coating resin layer 17 was measured by a stylus type step profiler, the thickness was 15 μm.

Subsequently, the coating resin layer 17 made of SU-8 was subjected to exposure processing, using a mirror projection mask aligner (MPA600 made by Canon Inc.) and as shown in FIGS. 4B and 4C, a latent image pattern 18 which becomes a crack inducing pattern in a subsequent process was formed. The latent image pattern 18 was formed toward the center of the heater board 15 from a position of 3 μm toward the center of the heater board 15 from the lateral faces of the outer peripheral edge of the coating resin layer 17, and was formed with a pattern width of 5 μm. As shown in FIG. 4C, the latent image pattern 18 is formed in the shape of a quadrangular frame along the outer peripheral edge of the quadrangular coating resin layer 17.

Figure 4D:
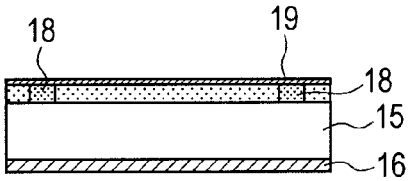

Subsequently, as shown in FIG. 4D, a Ta film 19 was formed with a film thickness of 2000 Å on this negative resist by a DC magnetron sputtering method using a sputtering apparatus (SYSTEM-51A made by Shibaura Mechatronics Corp.). At this time, the film forming pressure was at 0.25 Pa, and the electric discharge output was 1000 W.

Next, a positive resist (OFPR-50cp made by Tokyo Ohka Kogyo Co., Ltd.) which is not illustrated was coated on the Ta film 19. Then, this positive resist was patterned in a predetermined pattern using a mirror projection mask aligner (MPA600 made by Canon Inc.) so that the Ta film 19 remains on the previously formed latent image pattern 18.

Figure 4E:
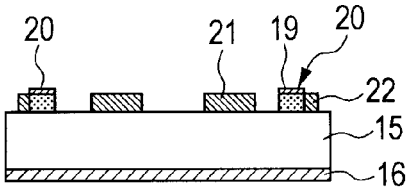

Subsequently, the Ta film 19 was etched by reactive ion etching using fluorocarbon-based gas with the positive type resist pattern as an etching mask, and as shown in FIG. 4E, a Ta pattern 20 for forming a crack inducing pattern was formed. Thereafter, the negative resist (SU-8) which was in the latent image state was developed and removed.

Thereby, the coating resin layer 17 serving as a height-defining resin layer is formed in a predetermined pattern with a predetermined height from an interface with the coating resin layer 2 which is the surface of the heater board 15 on which the coating resin layer 2 is formed.

Next, a positive Deep-UV resist (ODUR-1010 made by Tokyo Ohka Kogyo Co., Ltd.) was coated on the heater board 15 by the spin coating method, as a resin layer 21 for formation of ink flow passages which is a flow passage mold material. The rotational frequency during this spin coating was 350 rpm. After the coating of the positive Deep-UV resist, baking processing was performed at a baking temperature of 100° C. for a baking time of 3 minutes.

At this time, the measurement result of the film thickness of the positive Deep-UV resist (ODUR-1010) was 15 μmm after the baking processing. Next, this positive type Deep-UV resist was subjected to exposure processing using a mask aligner (UX-4000S made by USHIO INC.), and as shown in FIG. 4E, the resin layer 21 for formation of ink flow passages and the resin layer 22 for forming an air gap corresponding to the air gap 14 were formed in a predetermined pattern.

Figure 4F:
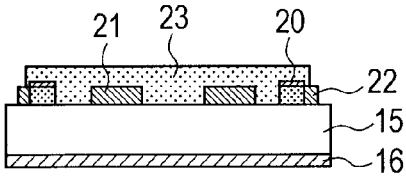

Next, as shown in FIG. 4F, the coating resin layer 23 was covered on the resin layer 21 for formation of ink flow passages and the resin layer 22 for formation of an air gap by the spin coating. As the coating resin layer 23, a negative resist (SU-8 made by Nippon Kayaku Co., Ltd.) was used. Baking processing was performed under the conditions that the rotational frequency during this spinning coating is 400 rpm, the baking temperature after the coating is 90° C., and the baking time is 6 minutes. The measurement result of the thickness of a nozzle layer including the coating resin layer 23 at this time was 30 μm.

Figure 4G:
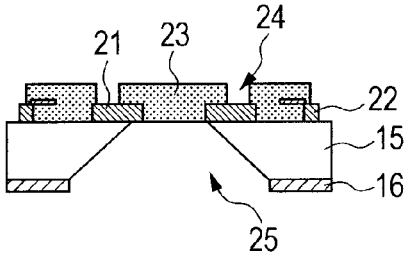
Figure 4H:
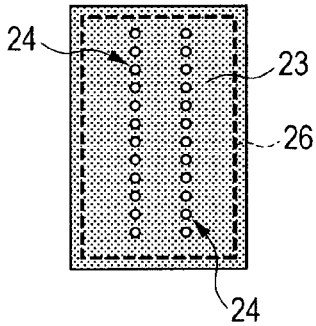

This nozzle layer was patterned, as shown in FIGS. 4G and 4H, using a mirror projection mask aligner (MPA600 made by Canon, Inc.) so as to have the desired arrangement of the discharge ports 24 and the appearance shape of the nozzle tip. At this time, the appearance shape of the nozzle tip was patterned so as to be arranged on the positive Deep-UV resist (ODUR-1010) formed in advance at the outer peripheral portion of the heater board 15.

Subsequently, the positive resist (OFPR made by Tokyo Ohka Kogyo Co., Ltd.) which is not illustrated was coated by the spin coat method on the thermal oxidation film 16 at the rear face of the heater board 15. At this time, baking processing was performed under the conditions that the spin coating rotational frequency is 500 rpm, the baking temperature is 90° C., and the baking time is 3 minutes. When the film thickness of the positive resist after the coating was measured, the film thickness was 3 μm. This positive resist (OFPR) was subjected to exposure processing using the mirror projection mask aligner (MPA600 made by Canon Inc.), and a pattern for forming an ink supply port was formed.

Next, the thermal oxidation film 16 was patterned by reactive ion etching using a mixed gas of fluorocarbon-based gas and oxygen with the positive resist as an etching mask. Thereafter, the positive resist was removed using a developing solution (NMD-3 made by Tokyo Ohka Kogyo Co., Ltd.).

Thereafter, silicon anisotropic etching was performed on the heater board 15 using a tetra-methyl ammonium hydroxyl solution with a liquid temperature of 80° C. and a concentration of 25 wt % with the thermal oxidation film 16 as an etching mask. From this, as shown in FIGS. 4G and 4H, the ink supply port 25 was formed in the heater board 15.

Next, the whole coating resin layer 23 was irradiated using a Deep-UV irradiation apparatus (CE-6000CT made by Canon Inc.). As a result, the resin layer 21 for formation of ink flow passages and the resin layer 22 for formation of an air gap made of the positive Deep-UV resist are made to have low molecules, before being removed by a developing solution, thereby completing the nozzle layer including the coating resin layer 23.

After the completion of the nozzle layer including the coating resin layer 23, the coating resin layer 23 and the heater board 15 were cut in a predetermined nozzle-tip shape, and then the nozzle tip was mounted on the tip support, using an adhesive for mounting.

Figure 4I:
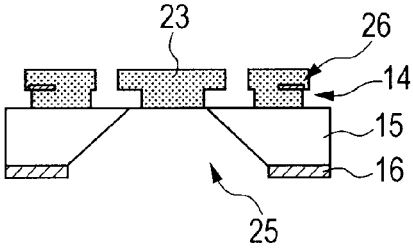

When the outer peripheral edge of the coating resin layer 23 was inspected after the mounting of the nozzle tip, peeling-off did not occur at the interface between the coating resin layer 23 and the heater board 15. On the other hand, as shown in FIG. 4I, a crack 26 with a width of 5 μm was generated in the crack inducing pattern. Accordingly, according to this working example, it is possible to prevent the interface between the coating resin layer 23 and the heater board 15 from being peeled-off due to the stress of the adhesive for mounting.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-280372, filed Dec. 10, 2009, which is hereby incorporated by reference herein in its entirety.

What is claimed is:

1. An ink discharge head comprising:

a coating resin layer having a plurality of discharge ports for discharging ink, and ink flow passages which communicate with the plurality of discharge ports, respectively; and a substrate having energy generation elements which generate energy for discharging the ink and adjoining the coating resin layer, wherein a crack inducing portion for relieving stress produced at an interface between the coating resin layer and the substrate is formed at lateral faces of an outer peripheral edge of the coating resin layer, the crack inducing portion being sandwiched by the coating resin layer.

2. The ink discharge head according to claim 1, wherein the crack inducing portion is formed from a material different from the coating resin layer along the interface between the coating resin layer and the substrate from the lateral faces of the outer peripheral edge to the inside of the coating resin layer.

3. The ink discharge head according to claim 2, wherein the crack inducing portion is made of a material such that the adhesion force between the crack inducing portion and the coating resin layer becomes smaller than the adhesion force between the substrate and the coating resin layer.

4. The ink discharge head according to claim 3, wherein the crack inducing portion is a metal layer.

5. The ink discharge head according to claim 1, wherein an air gap which is adjacent to the interface between the substrate and the coating resin layer and the crack inducing portion, respectively, is formed at the lateral faces of the outer peripheral edge of the coating resin layer.

6. The ink discharge head according to claim 1, wherein the crack inducing portion is a gap formed along the interface between the coating resin layer and the substrate from the lateral faces of the outer peripheral edge to the inside of the coating resin layer.

7. The ink discharge head according to claim 1, wherein the coating resin layer is formed in a quadrangular shape in a plane parallel to the interface, and the crack inducing portion is formed at least at four corners of the coating resin layer.

8. The ink discharge head according to claim 4, wherein the constituent material of the metal layer of the crack inducing portion is any one material of Pt, Au, W, and Ta, or alloys formed of these materials.

9. A method for manufacturing an ink discharge head including a coating resin layer having a plurality of discharge ports for discharging ink, and ink flow passages which communicate with the plurality of discharge ports, respectively, and a substrate having energy generation elements which generate energy for discharging the ink and adjoining the coating resin layer, a crack inducing portion for relieving stress produced at an interface between the coating resin layer and the substrate being formed at lateral faces of an outer peripheral edge of the coating resin layer, the crack inducing portion being sandwiched by the coating resin layer, the method comprising:

forming, in a predetermined pattern on the substrate, a height-defining resin layer for forming the crack inducing portion at a predetermined height from the surface of the substrate on which the coating resin layer is formed;

forming a layer forming the crack inducing portion in a predetermined pattern on the height-defining resin layer;

forming, in a predetermined pattern on the substrate, a resin layer for formation of ink flow passages;

covering the layer forming the crack inducing portion and the resin layer for formation of ink flow passages, thereby forming the coating resin layer on the substrate; and removing the resin layer for formation of ink flow passages.

* * * * *